US011629866B2

(12) United States Patent
Blanton et al.

(10) Patent No.: US 11,629,866 B2
(45) Date of Patent: Apr. 18, 2023

(54) SYSTEMS AND METHODS FOR DELAYED FLUID RECOVERY

(71) Applicant: Johnson Controls Technology Company, Auburn Hills, MI (US)

(72) Inventors: Norman J. Blanton, Norman, OK (US); Stephen C. Wilson, Oklahoma City, OK (US); Paul S. Willmus, Norman, OK (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 309 days.

(21) Appl. No.: 16/252,243

(22) Filed: Jan. 18, 2019

(65) Prior Publication Data

US 2020/0208851 A1 Jul. 2, 2020

Related U.S. Application Data

(60) Provisional application No. 62/787,659, filed on Jan. 2, 2019.

(51) Int. Cl.

| | |
|---|---|
| ***F24F 11/84*** | (2018.01) |
| ***F24F 3/153*** | (2006.01) |
| ***F24F 11/61*** | (2018.01) |

(52) U.S. Cl.

CPC ..... *F24F 3/153* (2013.01); *F24F 11/61* (2018.01); *F24F 11/84* (2018.01)

(58) Field of Classification Search

CPC ..... F24F 11/84; F24F 3/153; F24F 11/61

See application file for complete search history.

(56) References Cited

U.S. PATENT DOCUMENTS

| | | | |
|---|---|---|---|
| 2,770,100 | A | 11/1956 | Raney |
| 2,961,844 | A | 11/1960 | McGrath |
| 3,105,366 | A | 10/1963 | Atchison |
| 3,139,735 | A | 7/1964 | Malkoff |
| 3,203,196 | A | 8/1965 | Malkoff |

(Continued)

FOREIGN PATENT DOCUMENTS

| | | |
|---|---|---|
| EP | 1586772 | 10/2008 |
| WO | WO-1993010411 | 5/1993 |

(Continued)

*Primary Examiner* — Nael N Babaa

(74) *Attorney, Agent, or Firm* — Fletcher Yoder, P.C.

(57) ABSTRACT

A heating, ventilation, and/or air conditioning (HVAC) system includes a cooling circuit, a reheat circuit, a recovery circuit, and a control system. The cooling circuit includes a condenser, a compressor, an evaporator, and a three-way valve, and the HVAC system is configured to circulate refrigerant through the cooling circuit in a cooling operating mode. The reheat circuit includes a reheat heat exchanger, the compressor, the evaporator, and the three-way valve, and the HVAC system is configured to circulate refrigerant through the reheat circuit in a reheat operating mode. The recovery circuit extends between the condenser and the compressor and includes a recovery valve. The control system is configured to send a first signal to the three-way valve to switch the HVAC system between the cooling operating mode and the reheat operating mode and a second signal to the recovery valve to recover refrigerant from the cooling circuit at a subsequent time based on the first signal.

23 Claims, 8 Drawing Sheets

(56) References Cited

U.S. PATENT DOCUMENTS

| | | | | |
|---|---|---|---|---|
| 3,316,730 | A | 5/1967 | Lauer | |
| 3,631,686 | A | 1/1972 | Kautz | |
| 4,270,362 | A | 6/1981 | Lancia | |
| 4,271,678 | A | 6/1981 | Liebert | |
| 4,658,594 | A | 4/1987 | Langford | |
| 4,711,094 | A | 12/1987 | Ares | |
| 4,932,215 | A * | 6/1990 | Kanazawa | F25B 31/004 62/84 |
| 5,031,411 | A | 7/1991 | Gehring | |
| 5,062,276 | A | 11/1991 | Dudley | |
| 5,065,586 | A | 11/1991 | Shapiro-Baruch | |
| 5,088,295 | A | 2/1992 | Shapiro-Baruch | |
| 5,181,552 | A | 1/1993 | Eiermann | |
| 5,228,302 | A | 7/1993 | Eiermann | |
| 5,265,433 | A | 11/1993 | Beckwith | |
| 5,266,020 | A * | 11/1993 | Peterson | B29C 45/1732 264/572 |
| 5,309,725 | A | 5/1994 | Cayce | |
| 5,333,470 | A | 8/1994 | Dinh | |
| 5,337,577 | A | 8/1994 | Eiermann | |
| 5,345,776 | A | 9/1994 | Komazaki | |
| 5,390,505 | A | 2/1995 | Smith | |
| 5,400,607 | A | 3/1995 | Cayce | |
| 5,448,897 | A | 9/1995 | Dinh | |
| 5,477,700 | A | 12/1995 | Iio | |
| 5,493,871 | A | 2/1996 | Eiermann | |
| 5,526,650 | A | 6/1996 | Iritani | |
| 5,598,715 | A | 2/1997 | Edmisten | |
| 5,598,887 | A | 2/1997 | Ikeda | |
| 5,622,057 | A | 4/1997 | Bussjager | |
| 5,634,348 | A | 6/1997 | Ikeda | |
| 5,651,258 | A | 7/1997 | Harris | |
| 5,666,813 | A | 9/1997 | Brune | |
| 5,706,664 | A | 1/1998 | Hara | |
| 5,752,389 | A | 5/1998 | Harper | |
| 5,915,473 | A | 6/1999 | Ganesh | |
| 6,055,818 | A | 5/2000 | Valle | |
| 6,059,016 | A | 5/2000 | Rafalovich | |
| 6,122,923 | A | 9/2000 | Sullivan | |
| 6,123,147 | A | 9/2000 | Pittman | |
| 6,131,653 | A | 10/2000 | Larsson | |
| 6,170,271 | B1 | 1/2001 | Sullivan | |
| 6,321,558 | B1 | 11/2001 | Pruse | |
| 6,355,091 | B1 | 3/2002 | Felber | |
| 6,381,970 | B1 | 5/2002 | Eber | |
| 6,385,985 | B1 | 5/2002 | Bussjager | |
| 6,386,281 | B1 | 5/2002 | Ganesh | |
| 6,427,454 | B1 | 8/2002 | West | |
| 6,427,461 | B1 | 8/2002 | Whinery | |
| 6,557,771 | B2 | 5/2003 | Shah | |
| 6,604,688 | B2 | 8/2003 | Ganesh | |
| 6,612,119 | B2 | 9/2003 | Eber | |
| 6,644,049 | B2 | 11/2003 | Alford | |
| 6,666,040 | B1 | 12/2003 | Groenewold | |
| 6,672,087 | B1 | 1/2004 | Taras | |
| 6,694,756 | B1 | 2/2004 | Taras | |
| 6,701,723 | B1 | 3/2004 | Dobmeier | |
| 6,705,093 | B1 | 3/2004 | Taras | |
| 6,751,967 | B1 | 6/2004 | Chen | |
| 6,826,921 | B1 | 12/2004 | Uselton | |
| 6,941,770 | B1 | 9/2005 | Taras | |
| 6,955,057 | B2 | 10/2005 | Taras | |
| 6,986,264 | B1 | 1/2006 | Taras | |
| 7,028,492 | B2 | 4/2006 | Taras | |
| 7,059,151 | B2 | 6/2006 | Taras | |
| 7,062,930 | B2 | 6/2006 | Rayburn | |
| 7,219,505 | B2 | 5/2007 | Weber et al. | |
| 7,228,708 | B2 | 6/2007 | Taras | |
| 7,231,774 | B2 | 6/2007 | Taras | |
| 7,257,957 | B2 | 8/2007 | Lifson | |
| 7,272,948 | B2 | 9/2007 | Taras | |
| 7,275,384 | B2 | 10/2007 | Taras | |
| 7,287,394 | B2 | 10/2007 | Taras | |
| 7,290,399 | B2 | 11/2007 | Taras | |
| 7,325,414 | B2 | 2/2008 | Taras | |
| 7,434,415 | B2 | 10/2008 | Knight | |
| 7,469,555 | B2 | 12/2008 | Taras | |
| 7,523,623 | B2 | 4/2009 | Taras | |
| 7,559,207 | B2 | 7/2009 | Knight et al. | |
| 8,517,018 | B2 * | 8/2013 | Wenzel | A62B 7/14 128/205.14 |
| 10,174,958 | B2 | 1/2019 | Blanton et al. | |
| 2004/0089015 | A1 * | 5/2004 | Knight | F24F 3/153 62/324.1 |
| 2004/0144111 | A1 | 7/2004 | Matsuoka | |
| 2006/0130517 | A1 | 6/2006 | Merkys et al. | |
| 2008/0022705 | A1 | 1/2008 | Clearman | |
| 2008/0115515 | A1 | 5/2008 | Bailey et al. | |
| 2010/0191416 | A1 | 7/2010 | Yamaguchi et al. | |
| 2013/0206852 | A1 * | 8/2013 | Brykalski | B60N 2/5657 237/2 A |

FOREIGN PATENT DOCUMENTS

| | | |
|---|---|---|
| WO | WO-2008153669 | 12/2008 |
| WO | WO-2010039386 | 4/2010 |

* cited by examiner

SYSTEMS AND METHODS FOR DELAYED FLUID RECOVERY

CROSS REFERENCE TO RELATED APPLICATIONS

This application claims priority from and the benefit of U.S. Provisional Application Ser. No. 62/787,659, entitled "SYSTEMS AND METHODS FOR DELAYED FLUID RECOVERY," filed Jan. 2, 2019, which is hereby incorporated by reference in its entirety for all purposes.

BACKGROUND

The present disclosure generally relates to a heating, ventilation, and/or air conditioning (HVAC) system and, more particularly, to a system and method for delaying fluid recovery from a circuit of the HVAC system.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

An HVAC system may be used to thermally regulate an environment, such as a building, home, or other structure. The HVAC system generally includes a vapor compression system having heat exchangers, such as a condenser and an evaporator, which cooperate to transfer thermal energy between the HVAC system and the environment. In some instances, the HVAC system may change operating modes by adjusting the flow path of refrigerant through the HVAC system. More specifically, refrigerant may be circulated through a first circuit in one operating mode of the HVAC system, and refrigerant may be circulated through a second circuit in another mode of the HVAC system. For example, adjusting refrigerant flow from one circuit to another circuit may transition the HVAC system from operating in a cooling mode to operating in a dehumidification mode. However, changing refrigerant flows between different refrigerant circuits may involve complications due to pressure differences in the various refrigerant circuits and conduits.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) system includes a cooling circuit, a reheat circuit, a recovery circuit, and a control system. The cooling circuit includes a condenser, a compressor, an evaporator, and a three-way valve, and the HVAC system is configured to circulate refrigerant through the cooling circuit in a cooling operating mode. The reheat circuit includes a reheat heat exchanger, the compressor, the evaporator, and the three-way valve, and the HVAC system is configured to circulate refrigerant through the reheat circuit in a reheat operating mode. The recovery circuit extends between the condenser and the compressor and includes a recovery valve. The control system is configured to send a first signal to the three-way valve to switch the HVAC system between the cooling operating mode and the reheat operating mode and a second signal to the recovery valve to recover refrigerant from the cooling circuit at a subsequent time based on the first signal.

In another embodiment, a control system for a heating, ventilation, and/or air conditioning (HVAC) system, includes a three-way valve, a recovery valve, and a controller. The three-way valve is configured to actuate to direct refrigerant through a cooling circuit of the HVAC system in a cooling operating mode and through a reheat circuit of the HVAC system in a reheat operating mode. The recovery valve is configured to actuate to direct refrigerant from the cooling circuit to a recovery circuit of the HVAC system. The controller is configured to execute a time delay after sending a first signal to actuate the three-way valve to switch between the cooling operating mode and the reheat operating mode and send a second signal to actuate the recovery valve of the HVAC system after execution of the time delay.

In yet another embodiment, a heating, ventilation, and/or air conditioning (HVAC) system includes a cooling circuit, a reheat circuit, a first recovery circuit, a second recovery circuit, and a control system. The cooling circuit includes a condenser, a compressor, an evaporator, and a three-way valve, and the HVAC system is configured to circulate refrigerant through the cooling circuit in a cooling operating mode. The reheat circuit includes a reheat heat exchanger, the compressor, the evaporator, and the three-way valve, and the HVAC system is configured to circulate refrigerant through the reheat circuit in a reheat operating mode. The first recovery circuit extends between the condenser and the compressor and includes a first recovery valve. The second recovery circuit extends between the reheat heat exchanger and the compressor and includes a second recovery valve. The control system is configured to send a first signal to the three-way valve to switch the HVAC system between the cooling operating mode and the reheat operating mode and is configured to subsequently send a second signal to the first recovery valve or to the second recovery valve to recover refrigerant from the cooling circuit or from the reheat circuit, respectively, after a time delay calculated based on the first signal.

BRIEF DESCRIPTION OF THE DRAWINGS

Various aspects of the present disclosure may be better understood upon reading the following detailed description and upon reference to the drawings, in which.

DETAILED DESCRIPTION

Figure 1:
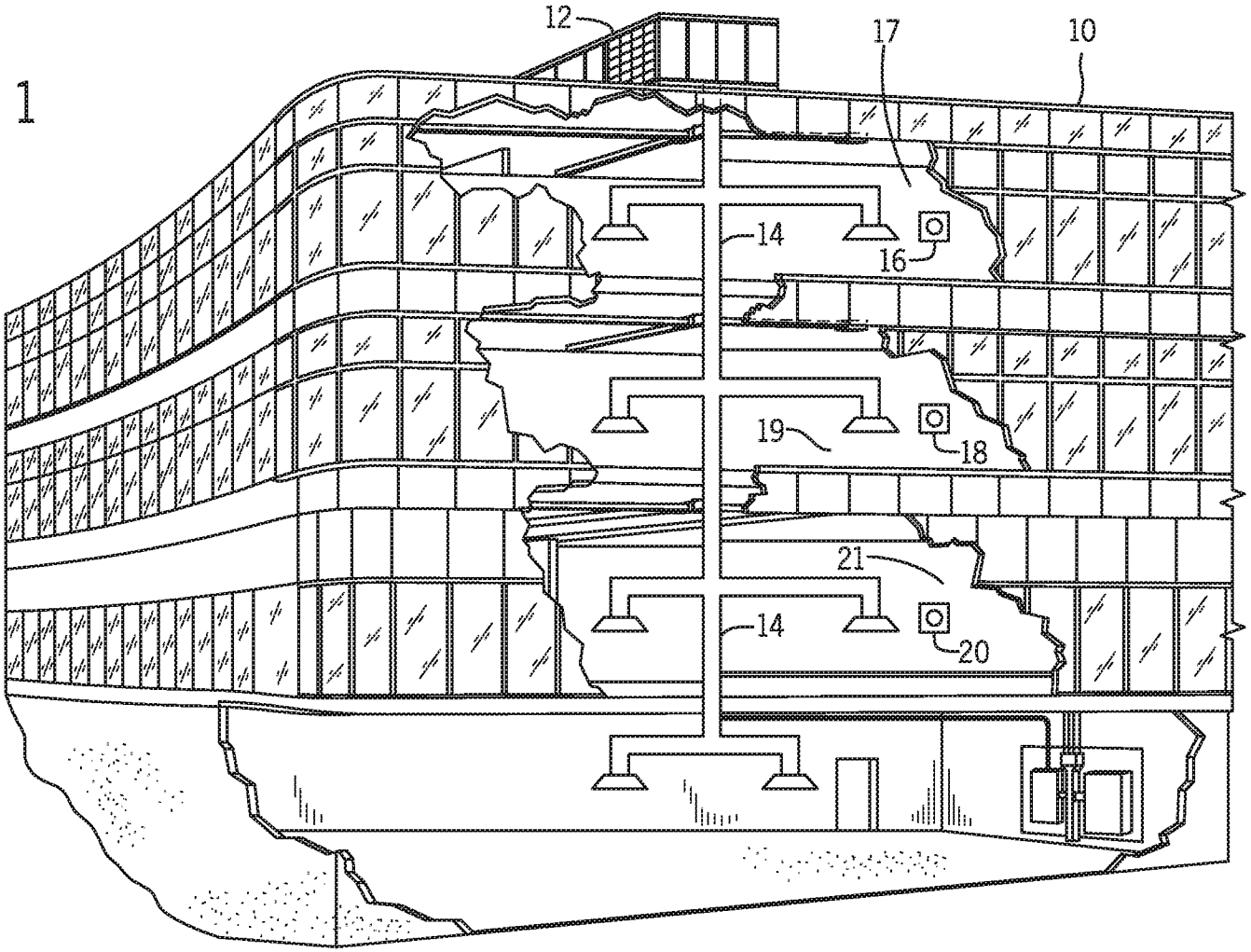
FIG. 1 is a perspective view of a heating, ventilation, and/or air conditioning (HVAC) system for building environmental management that may employ one or more HVAC units, in accordance with an embodiment of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

Generally, a heating, ventilation, and/or air conditioning (HVAC) system may control climate conditions, such as temperature and/or humidity, within a building. The HVAC system may operate in different modes to control the climate conditions within the building, such as controlling temperature and/or humidity of the air. For example, the HVAC system may operate in a cooling operating mode, whereby refrigerant is flowed through a cooling circuit in order to cool air supplied to the building. In a reheat operating mode, the HVAC system may circulate the refrigerant through a reheat circuit in order to lower the humidity of air supplied to the building. The HVAC system may switch between the cooling operating mode and the reheat operating mode via a three-way valve that switches refrigerant flow between the cooling circuit and the reheat circuit.

In certain embodiments, the HVAC system may include recovery circuit(s) that recover refrigerant from the cooling circuit and/or the reheat circuit when circulation of refrigerant through the cooling circuit and/or the reheat circuit is suspended. For example, a recovery circuit may extend between the cooling circuit and another portion of the HVAC system, such as a conduit upstream of a compressor of the HVAC system, and may recover refrigerant from the cooling circuit when the HVAC system switches from the cooling operating mode to the reheat operating mode. The recovery circuit may include a recovery valve that controls the flow of refrigerant from the cooling circuit and through the recovery circuit. Additionally or alternatively, another recovery circuit may extend between the reheat circuit and the conduit upstream of the compressor and may recover refrigerant from the reheat circuit when the HVAC system switches from the reheat operating mode to the cooling operating mode. The other/additional recovery circuit may also include a recovery valve that controls the flow of refrigerant from the reheat circuit and through the other/additional recovery circuit.

In some instances, the three-way valve may not completely or fully adjust positionally to transition refrigerant flow from the cooling circuit to the reheat circuit and/or the position switching of the three-valve may be delayed due to pressure differences within the circuits, such as a pressure difference between the cooling circuit and the reheat circuit. Such pressure differences may be caused by opening the recovery valve in the recovery circuit, among other reasons. For example, opening the recovery valve in the recovery circuit coupled to the cooling circuit may cause a drop in pressure within the cooling circuit as the refrigerant drains from the cooling circuit. Similarly, opening the recovery valve in the recovery circuit coupled to the reheat circuit may cause a pressure drop within the reheat circuit as the refrigerant drains from the reheat circuit. It is now recognized that temporarily maintaining pressure within the cooling circuit during a transition from cooling circuit operation to reheat circuit operation may improve positional switching of the three-way valve. Likewise, temporarily maintaining pressure within the reheat circuit during a transition from reheat circuit operation to cooling circuit operation may also improve positional switching of the three-way valve.

Accordingly, the present disclosure provides systems and methods that control opening of a recovery valve to recover the refrigerant from the cooling circuit and/or the reheat circuit. As discussed in detail below, the disclosed techniques enable the HVAC system to efficiently and quickly switch between the cooling operating mode and the reheat operating mode. For example, the HVAC system may include a control system that first actuates the three-way valve to transition from a cooling circuit operation position and a reheat circuit operation position, or vice versa. Thereafter, the control system may open the recovery valve of a recovery circuit extending from the cooling circuit or reheat circuit after an appropriate time delay. The time delay may be any suitable time period between about one second to about ten minutes after the three-way valve is actuated. The time delay causes refrigerant pressure within the cooling circuit or reheat circuit to be maintained, and thus assist in positional transition of the three-way valve, before the recovery valve is opened to recover refrigerant from the cooling circuit or reheat circuit. As such, the systems and methods described herein enable efficient and quick transition between the cooling operating mode and the reheat operating mode while allowing for recovery of the refrigerant from the cooling circuit and/or the reheat circuit.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

In any case, the HVAC unit 12 may be an air cooled device that implements a refrigeration cycle to provide conditioned air to the building 10. For example, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the air is conditioned, the HVAC unit 12 may supply the conditioned air to the building 10 via ductwork 14 extending throughout the building 10 from the HVAC unit 12. For example, the ductwork 14 may extend to various individual floors or other sections of the building 10. In some embodiments, the HVAC unit 12 may include a heat pump that provides both heating and cooling to the building 10, for example, with one refrigeration circuit implemented to operate in multiple different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other equipment, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and/or the like. Moreover, the control device 16 may include computer systems that are integrated with or separate from other building control or monitoring systems, and even systems that are remote from the building 10. In some embodiments, the HVAC unit 12 may operate in multiple zones of the building and may be coupled to multiple control devices that each control flow of air in a respective zone. For example, a first control device 16 may control the flow of air in a first zone 17 of the building, a second control device 18 may control the flow of air in a second zone 19 of the building, and a third control device 20 may control the flow of air in a third zone 21 of the building.

Figure 2:
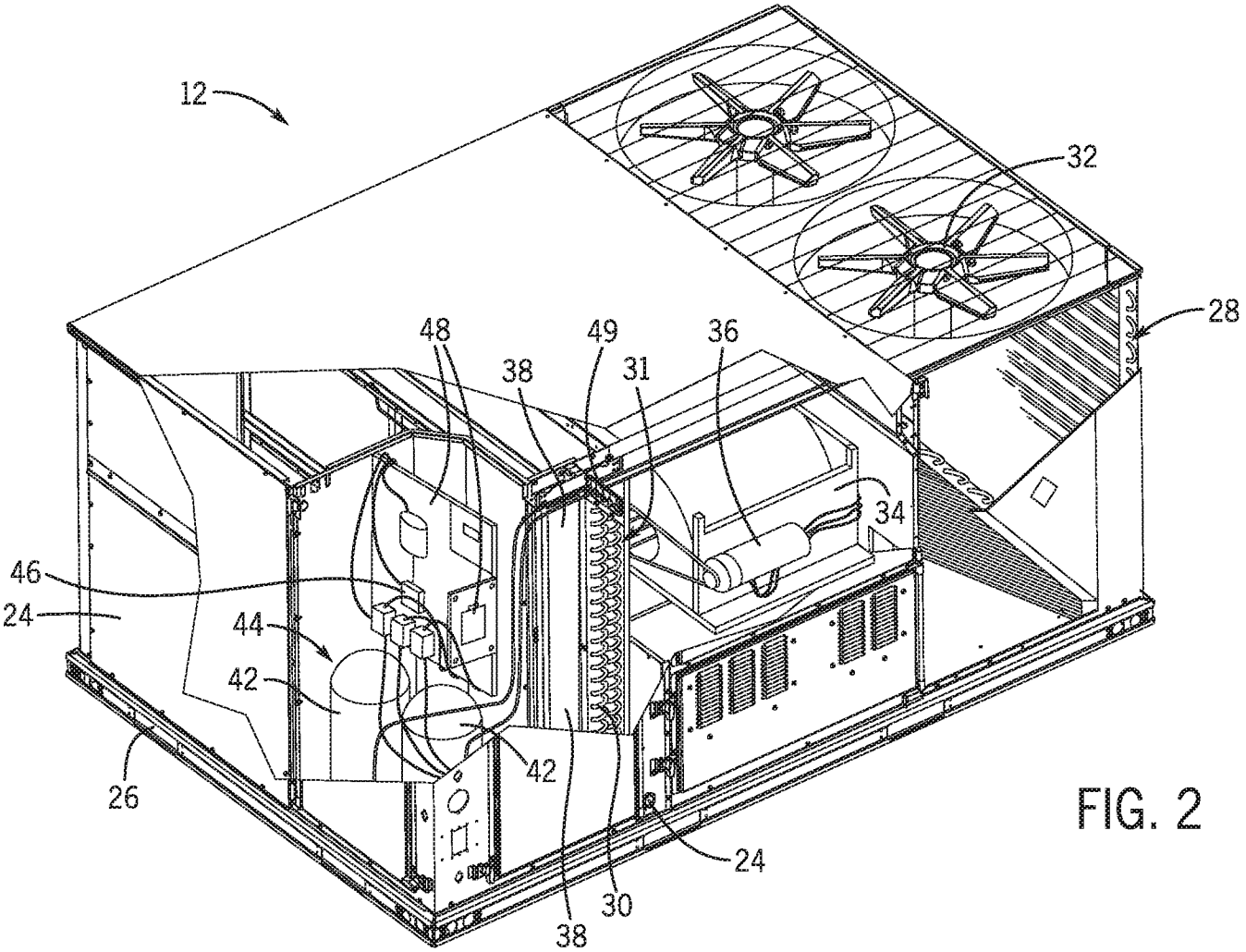
FIG. 2 is a perspective view of a packaged HVAC unit, in accordance with an embodiment of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 or enclosure encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board or controller 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
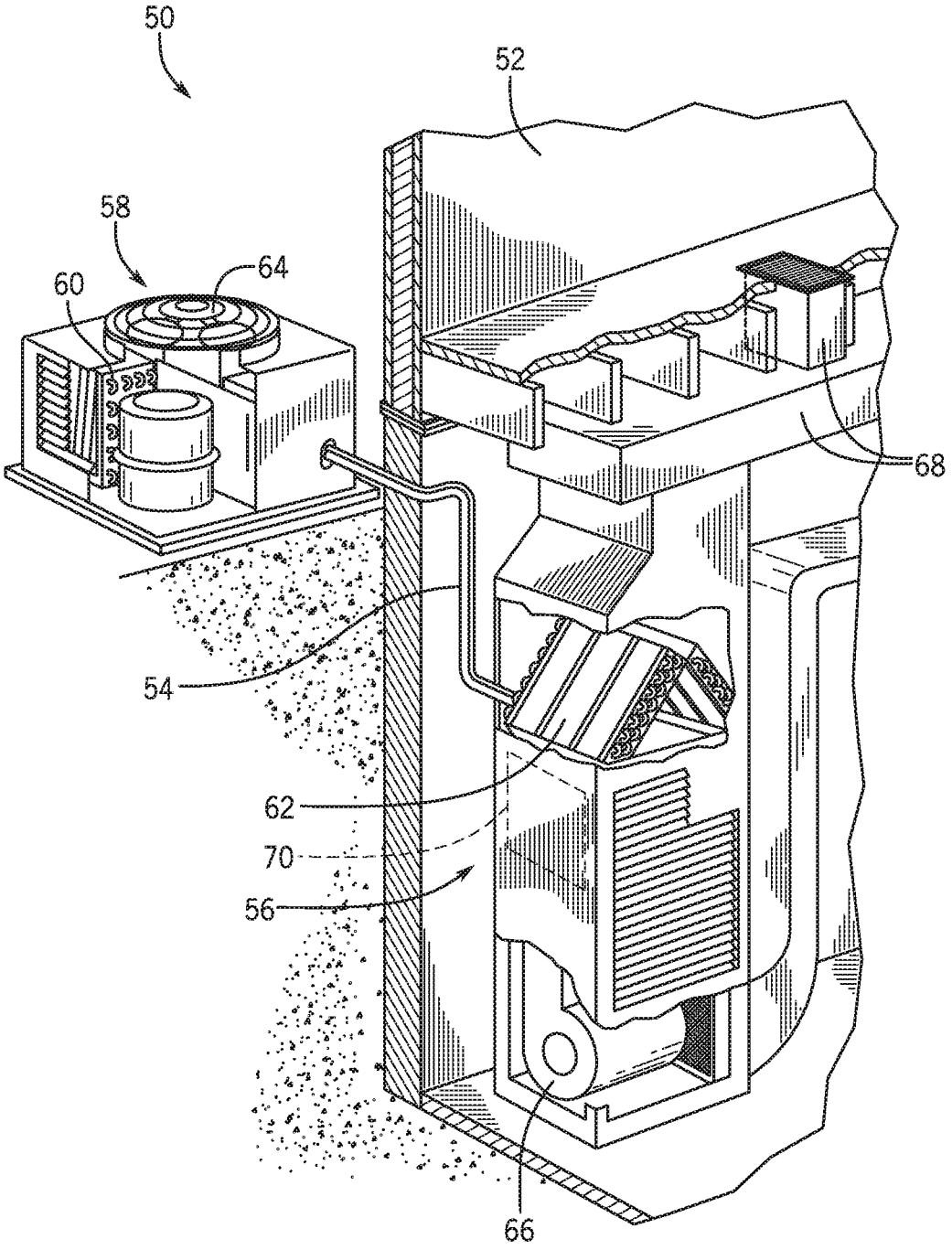
FIG. 3 is a perspective view of a residential, split heating and cooling system, in accordance with an embodiment of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
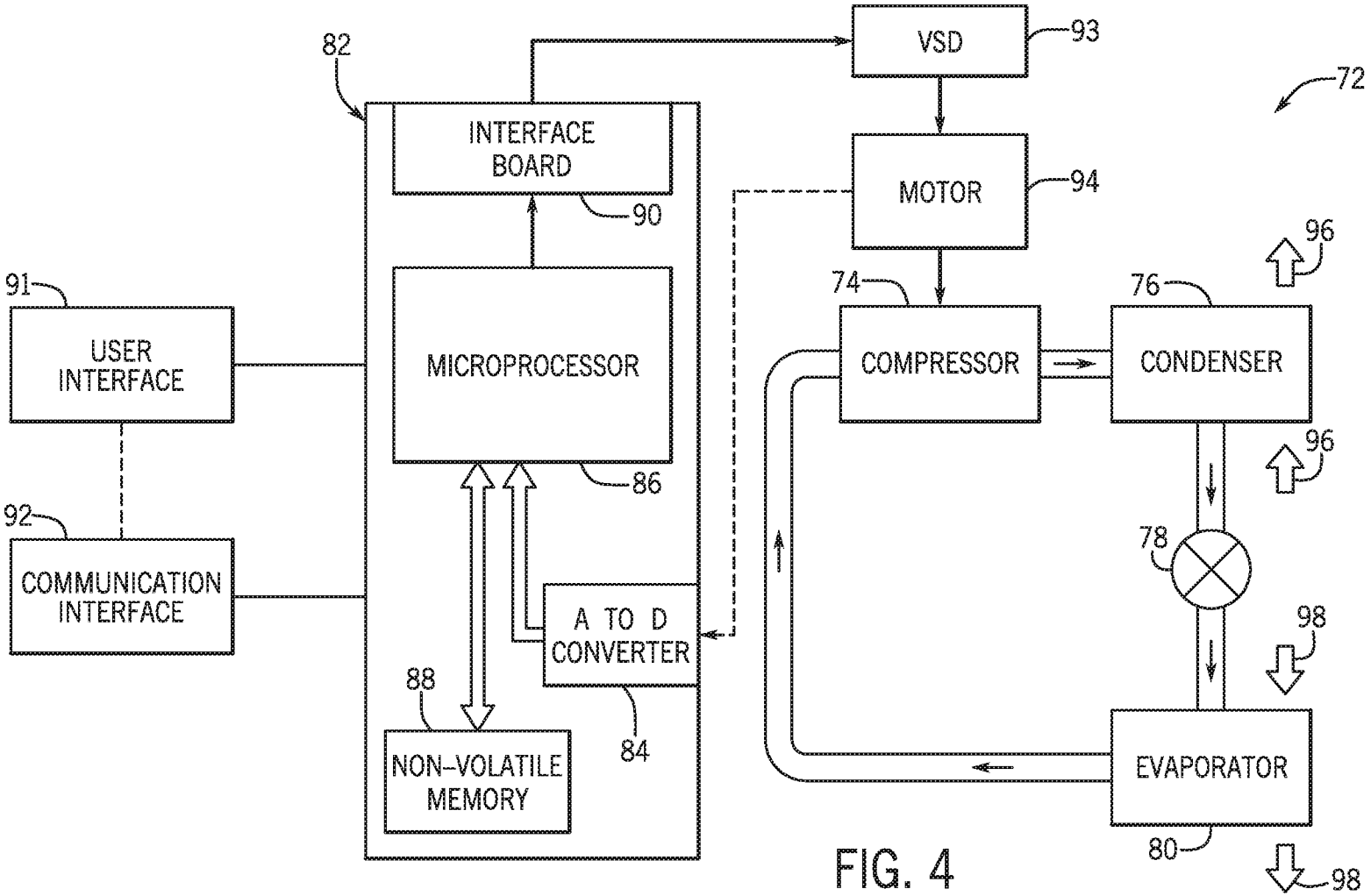
FIG. 4 is a schematic of a vapor compression system that may be used in an HVAC system, in accordance with an embodiment of the present disclosure.

FIG. 4 is an embodiment of a vapor compression system 72 that may be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that may be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The description above with reference to FIGS. 1-4 is intended to be illustrative of the context of the present disclosure. The techniques of the present disclosure may be incorporated with any or all of the features described above. In particular, as will be discussed in more detail below, the present disclosure provides techniques that enable an HVAC system to efficiently transition between a cooling operating mode and a reheat operating mode while allowing for the recovery of refrigerant from a cooling circuit and/or a reheat circuit of the HVAC system. For example, a control system of the HVAC system may delay recovery of the refrigerant from the cooling circuit or the reheat circuit until after the HVAC system switches between the cooling operating mode and the reheat operating mode.

Figure 5:
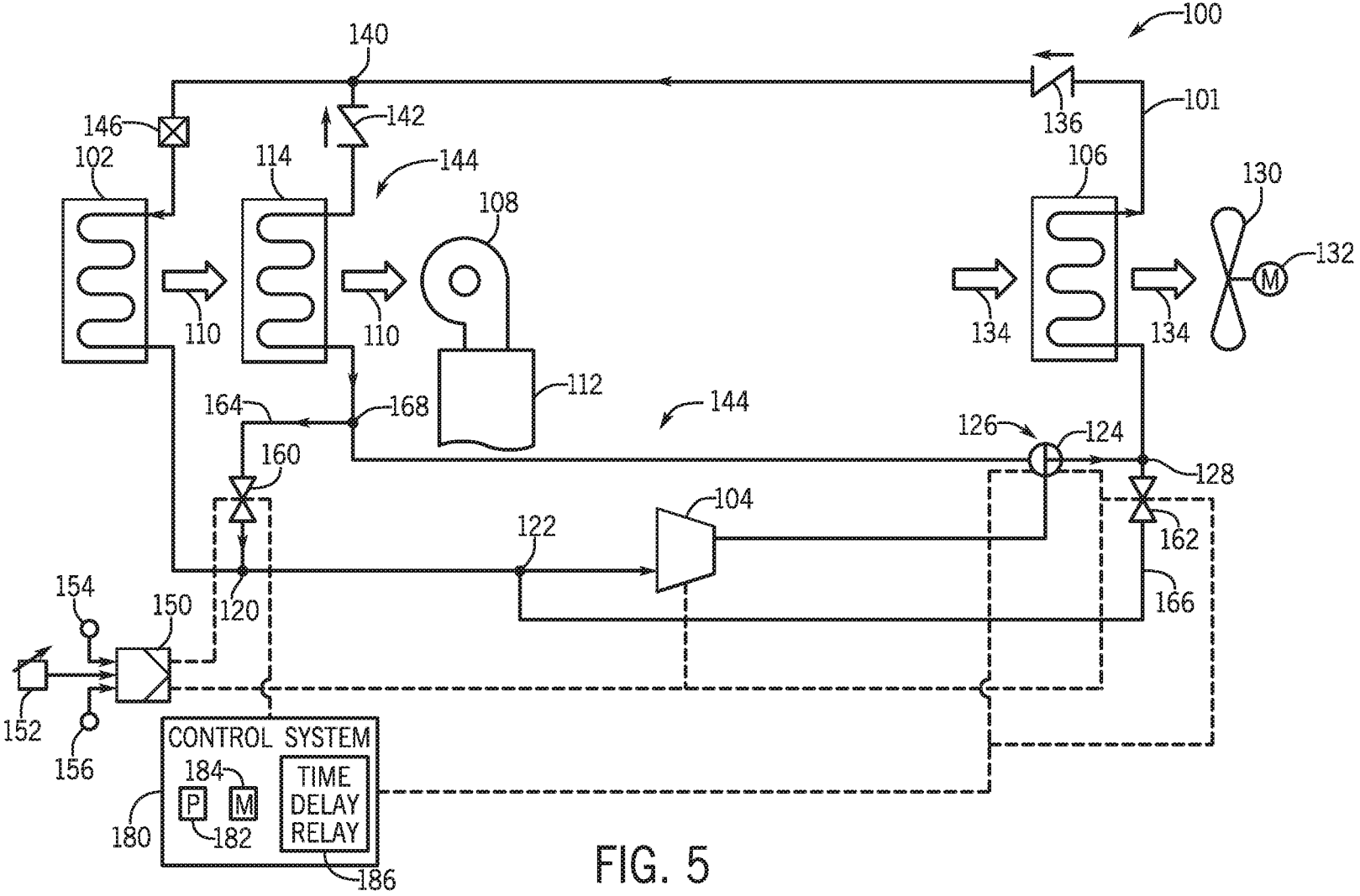
FIG. 5 is a schematic diagram of an HVAC system operating in a cooling operating mode, in accordance with an embodiment of the present disclosure.
Figure 6:
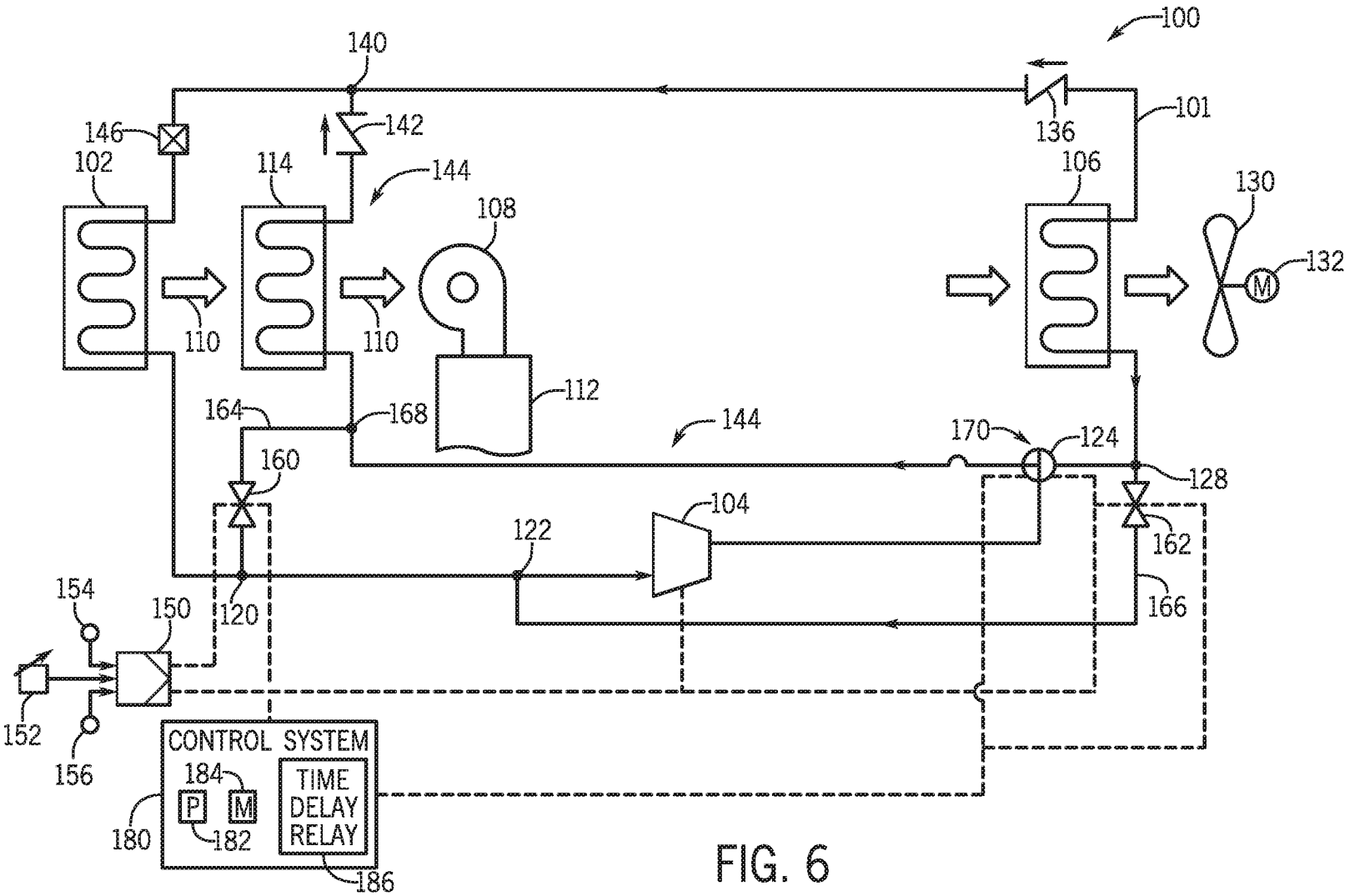
FIG. 6 is a schematic diagram of an HVAC system operating in a reheat operating mode, in accordance with an embodiment of the present disclosure.

To help illustrate, FIGS. 5 and 6 are schematic diagrams of an HVAC system 100 that may switch between a cooling operating mode and a reheat operating mode. In particular, FIG. 5 illustrates the HVAC system 100 operating in the cooling operating mode, and FIG. 6 illustrates the HVAC system 100 operating in the reheat operating mode. The cooling operating mode may be employed to provide cooled air to a conditioned space, while the reheat operating mode may be employed to provide dehumidified air to the conditioned space when additional cooling of the air is not desired. For example, on days when the ambient temperature is relatively low, and the humidity is relatively high, the reheat operating mode may be employed to provide dehumidified air at a comfortable temperature. It should be noted that the HVAC system 100 may include embodiments or components of the HVAC unit 12 shown in FIG. 1, embodiments or components of the residential heating and cooling system 50 shown in FIG. 3, a rooftop unit (RTU), or any other suitable HVAC system.

As shown in FIG. 5, refrigerant flows through the HVAC system 100 within a cooling circuit 101 during the cooling operating mode. Along the cooling circuit 101, refrigerant flows through evaporator 102, compressor 104, and condenser 106. Blower assembly 108 draws air 110, generally represented by arrows, across the evaporator 102. As the air 110 flows across the evaporator 102, the refrigerant flowing through the evaporator 102 absorbs heat from the air 110 to cool the air 110. The cooled air 110 may then be provided to the conditioned space through ductwork 112. As the air 110 is cooled, moisture also may be removed from the air 110 to dehumidify the air 110. For example, as the air 110 flows across heat exchanger tubes of the evaporator 102, moisture within the air 110 may condense on the tubes and may be directed to a drain.

The blower assembly 108 also may draw the air 110 across reheat heat exchanger 114, which is inactive in the cooling operating mode. The reheat heat exchanger 114 is disposed generally downstream of the evaporator 102 with respect to the direction of air 110 flow, and accordingly, the cooled air 110 exiting evaporator 102 may flow across the reheat heat exchanger 114. However, in the cooling operating mode, the reheat heat exchanger 114 contains little or no refrigerant, and accordingly, no substantial heating or cooling occurs as the air 110 flows across reheat heat exchanger 114 in the cooling operating mode.

As the air 110 flows across the evaporator 102, the air 110 transfers heat to the refrigerant flowing within the evaporator 102. As the refrigerant is heated, at least a portion of, or a large portion of, the refrigerant may evaporate into a vapor. The heated refrigerant exiting the evaporator 102 then flows through connection points 120 and 122 disposed along the cooling circuit 101 to enter the suction side of the compressor 104. The compressor 104 reduces the volume available for the refrigerant vapor and, consequently, increases the pressure and temperature of the refrigerant.

The refrigerant exits the discharge side of the compressor 104 as a high pressure and temperature vapor that flows to a three-way valve 124. In the cooling operating mode, the three-way valve 124 is in a cooling mode operating position 126 and is fluidly coupled to the cooling circuit 101. As such, in the cooling operating mode, the three-way valve 124 directs the refrigerant through connection point 128 of the cooling circuit 101 to the condenser 106.

One or more fans 130, which are driven by one or more motors 132, draw air 134 across the condenser 106 to cool the refrigerant flowing within the condenser 106. According to certain embodiments, the motor 132 may be controlled by a variable speed drive (VSD) or variable frequency drive (VFD) that may adjust the speed of the motor 132, and thereby adjust the speed of the fans 130. The fans 130 may force or draw air 134 across heat exchanger tubes of the condenser 106. As the air 134 flows across tubes of the condenser 106, heat transfers from the refrigerant vapor to the air 134, producing heated air 134 and causing the refrigerant vapor to condense into a liquid. The refrigerant exiting the condenser 106 then flows through a check valve 136 to a connection point 140 along the cooling circuit 101. The check valve 136 may be designed to allow unidirectional flow within the cooling circuit 101 in the direction from the condenser 106 to the connection point 140. In other words, the check valve 136 may impede the flow of refrigerant from the connection point 140 into the condenser 106.

In the cooling operating mode, a check valve 142 inhibits the flow of refrigerant from the connection point 140 into a reheat circuit 144 that may be employed in the reheat operating mode to heat air exiting the reheat heat exchanger 114. Accordingly, in the cooling operating mode, the refrigerant flows from connection point 140 to an expansion device 146, where the refrigerant expands to become a low pressure and temperature liquid. In certain embodiments, some vapor also may be present after expansion in the expansion device 146. The expansion device 146 may be a thermal expansion valve (TXV); however, according to other embodiments, the expansion device 146 may be an electromechanical valve, an orifice, or a capillary tube, among others. Further, in other embodiments, multiple expansion devices 146 may be employed. From the expansion device 146, the refrigerant then enters the evaporator 102, where the low temperature and pressure refrigerant may then again absorb heat from the air 110.

As discussed above, the reheat operating mode may be employed to provide dehumidification when additional cooling is not desired. For example, on days when the ambient temperature is low, but the humidity is high, it may be desirable to provide dehumidified air that is not substantially reduced in temperature to avoid over-cooling the conditioned space. In order to transition from the cooling mode to the reheat mode, the three-way valve 124 is switched from the cooling mode operating position 126 shown in FIG. 5 to a reheat mode operating position 170 shown in FIG. 6.

With the three-way valve 124 in the reheat mode operating position 170, high-pressure and temperature refrigerant exits the compressor 104 and is directed to the three-way valve 124 and the other portions of the reheat circuit 144. Accordingly, in the reheat operating mode, no refrigerant is directed into the condenser 106. The reheat circuit 144 may include the reheat heat exchanger 114, the evaporator 102, the compressor 104, or a combination thereof. Within the reheat circuit 144, the refrigerant, which is primarily vapor, flows through a connection point 168 of the reheat circuit 144 to the reheat heat exchanger 114. As the refrigerant flows through the reheat heat exchanger 114, the refrigerant transfers heat to the air 110 exiting the evaporator 102. In other words, the high temperature refrigerant flowing through the reheat heat exchanger 114 heats the air 110 exiting the evaporator 102. Accordingly, in the reheat operating mode, the air 110 is first cooled and dehumidified as the air 110 flows across the evaporator 102. The cooled air 110 is then reheated as the air 110 flows across the reheat heat exchanger 114. Thereafter, the dehumidified air may be provided to the conditioned space through the ductwork 112.

As the refrigerant flows through the reheat heat exchanger 114, the refrigerant transfers heat to the air 110 and the refrigerant is condensed. According to certain embodiments, the refrigerant exiting the reheat heat exchanger 114 may be condensed and/or subcooled. The refrigerant then flows through the check valve 142 to the connection point 140. From the connection point 140, the refrigerant is then directed through the expansion device 146 and the evaporator 102. From the evaporator 102, the refrigerant returns to the compressor 104 where the process may begin again.

Operation of the HVAC system 100 may be governed by control system 150 having one or more controllers configured to execute the operational sequences described herein. The control system 150 may transmit control signals to the compressor 104, such as to a motor that drives the compressor 104, and to the three-way valve 124 to regulate operation of the HVAC system 100. Although not illustrated, the control system 150 also may be electrically coupled to the blower assembly 108 and/or the motor 132. The control system 150 may receive input from a thermostat 152, and/or sensors 154 and 156, and may use information received from these devices to determine when to switch the HVAC system 100 between the cooling operating mode and the reheat operating mode. Further, in other embodiments, the control system 150 may receive inputs from local or remote command devices, computer systems and processors, and mechanical, electrical, and electromechanical devices that manually or automatically set a temperature and/or humidity related set point for the HVAC system 100.

The sensors 154 and 156 may detect the temperature and the humidity, respectively, within the conditioned space and may provide data and/or control signals indicative of the temperature and humidity to the control system 150. The control system 150 may then compare the temperature and/or humidity data received from the sensors 154 and 156 to a set point received from the thermostat 152. For example, the control system 150 may determine whether the sensed temperature is higher than a temperature set point. If the sensed temperature is higher than the set point, the control system 150 may place the HVAC system 100 in the cooling operating mode. In particular, the control system 150 may enable operation of the compressor 104 and may actuate the three-way valve 124 to be in the cooling mode operating position 126. In certain embodiments, the control system 150 also may adjust operation of the blower assembly 108 and the motor 132. In another example, if the sensed temperature is below the temperature set point, the control system 150 may then determine whether the sensed humidity is higher than a humidity set point. If the sensed humidity is higher than the set point, and the conditioned space does not call for cooling, the control system 150 may place the HVAC system 100 in the reheat operating mode, as described further below with respect to FIG. 6.

The control system 150 may execute hardware or software control algorithms to govern operation of the HVAC system 100. According to certain embodiments, the control system 150 may include an analog to digital (A/D) converter, a microprocessor, a non-volatile memory, and one or more interface boards. For example, in certain embodiments, the control system 150 may include a primary controller that receives control signals and/or data from the thermostat 152 and the temperature sensor 154. The primary controller may be employed to govern operation of the compressor 104, as well as other system components. The control system 150 also may include a reheat controller that receives data and/or control signals from the humidity sensor 156. According to certain embodiments, the sensor 156 may be a dehumidistat. The reheat controller may be employed to govern the position of the three-way valve 124 and also valves 160 and 162, which are recovery valves discussed in further detail below, as well as other system components. However, in other embodiments, the configuration of the control system 150 may vary. Further, other devices may, of course, be included in the system, such as additional pressure and/or temperature transducers or switches that sense temperatures and pressures of the refrigerant, the heat exchangers, the inlet and outlet air, and so forth.

According to certain embodiments, the control system 150 may employ two different temperature set points to determine when to switch the HVAC system 100 between the reheat operating mode and the cooling operating mode. For example, the control system 150 may use a first temperature set point to determine when to place the HVAC system 100 in the cooling operating mode when the humidity is low, such as below a humidity set point. If the sensed humidity is below the humidity set point, and the sensed temperature is above the first temperature set point, the control system 150 may operate the HVAC system 100 in the cooling operating mode. The control system 150 may use a second temperature set point to determine when to place HVAC unit in the cooling operating mode when the humidity is high, such as above the humidity set point. According to certain embodiments, the second temperature set point may be approximately two to six degrees higher than the first temperature set point. If the sensed humidity is above the humidity set point and the temperature is above the second temperature set point, the control system 150 may place the HVAC system 100 in the cooling operating mode. However, if the sensed humidity is above the humidity set point and the temperature is below the second temperature set point, the control system 150 may operate the HVAC system 100 in the reheat operating mode.

As illustrated, the control system 150 is also electrically coupled to the valves 160 and 162 of refrigerant recovery circuits 164 and 166, respectively. The refrigerant recovery circuits 164 and 166 may be employed to recover refrigerant from the reheat heat exchanger 114 and the condenser 106, respectively, when switching between the cooling operating mode and the reheat operating mode. For example, when switching from the cooling operating mode to the reheat operating mode, the control system 150 may open the valve 162, which is closed during the cooling operating mode, to direct refrigerant from the condenser 106 through the connection point 128 and the valve 162 to the connection point 122 where the refrigerant may be directed to the suction side of the compressor 104. When switching from the reheat operating mode to the cooling operating mode, the control system 150 may open the valve 160, which is closed in the reheat operating mode, to drain refrigerant from the reheat heat exchanger 114, through a connection point 168 of the reheat circuit 144, and through the valve 160 to the connection point 120 where the refrigerant may be directed to the suction side of the compressor 104. Both recovery circuits 164 and 166 are connected to the suction side of the compressor 104 to draw refrigerant from the refrigerant recovery circuits 164 and 166 back to the compressor 104.

According to certain embodiments, the refrigerant recovery circuits 164 and 166 are designed to allow refrigerant from the inactive reheat heat exchanger 114 or the inactive condenser 106 to return to the compressor 104. The return of refrigerant to the suction side of the compressor 104 may ensure that most, or all, of the refrigerant is circulated through the compressor 104 in both the cooling operating mode and the reheat operating mode. Accordingly, in the cooling operating mode shown in FIG. 5, where the three-way valve 124 is in cooling operating mode position 126, the valve 160 may be open, while valve 162 is closed. In the reheat operating mode shown in FIG. 6, where the three-way valve 124 is in a reheat operating mode position 170, the valve 162 may be open, while the valve 160 is closed.

The control system 150 may cycle the valve 160 or 162 on and off or may leave the valve 160 or 162 open to allow refrigerant from the inactive reheat heat exchanger 114 or the inactive condenser 106 to return to the compressor 104. For example, in certain embodiments, the control system 150 may close the valve 160 or 162 after a set amount of time. However, in other embodiments, the control system 150 may leave the valve 160 or 162 open until switching to the other mode of operation. For example, in these embodiments, the control system 150 may close valve 160 when switching to the reheat operating mode and may close valve 162 when switching to the cooling operating mode.

Additionally or alternatively, the HVAC system 100 may include a control system 180 configured to control operation of the three-way valve 124, the valve 160, the valve 162, or a combination thereof. As illustrated, the control system 180 includes a processor 182, a memory 184, and a time delay relay 186. The control system 180 may, via a signal sent from the processor 182, actuate the three-way valve 124 to switch between positions enabling operation of the cooling circuit 101 and the reheat circuit 144 to allow the HVAC system 100 to operate in the cooling operating mode and the reheat operating mode, respectively. The control system 180 may also open the valve 160 to enable recovery of the refrigerant from the reheat circuit 144, while the HVAC system 100 is operating in the cooling operating mode, and may open the valve 162 to enable recovery of the refrigerant from the cooling circuit 101, while the HVAC system 100 is operating in the reheat operating mode.

In certain embodiments, the control system 180 may control the three-way valve 124, the valve 160, the valve 162, or the combination thereof, by executing a time delay via the time delay relay 186. For example, to facilitate transition of the HVAC system 100 from the cooling operating mode to the reheat operating mode, the control system 180 may first send a signal to the three-way valve 124 to transition from the cooling mode operating position 126 of FIG. 5 to the reheat mode operating position 170 of FIG. 6. While the three-way valve 124 transitions from enabling operation of the cooling circuit 101 to enabling operation of the reheat circuit 144, the valve 162 may remain closed. Additionally, the valve 160 may be closed or open during the transition from the cooling operating mode to the reheat operating mode. While the valve 162 remains closed, a pressure within the cooling circuit 101 may be greater than or substantially the same as a pressure within the reheat circuit 144. The greater or substantially similar pressure within the cooling circuit 101 may facilitate or may assist transition of the three-way valve 124 from being fluidly coupled with the cooling circuit 101 to being fluidly coupled with the reheat circuit 144. For example, the three-way valve 124 may be a snap-acting valve that flips to a lower pressure circuit when provided with the appropriate signal.

Upon actuation of the three-way valve 124, the control system 180 may execute the time delay, via the time delay relay 186, prior to opening the valve 162. The time delay may facilitate or assist actuation of the three-way valve 124, because the pressure of the refrigerant within the condenser 106 and within the cooling circuit 101 may generally be maintained. The time delay may be any time period between about one second and thirty minutes, two seconds and ten minutes, two seconds and two minutes, two seconds and sixty seconds, two seconds and twenty seconds, five seconds and thirty seconds, or any other suitable time delay. In some embodiments, the time delay may be received via user input and/or may be determined or calculated by the control system 180 based on user input(s), a time associated with a control signal sent to the three-way valve 124, a type of refrigerant, relative sizes/lengths of the cooling circuit 101 and the reheat circuit 144, a sensed pressure of the cooling circuit 101, a sensed pressure of the reheat circuit 144, other operating conditions of the HVAC system 100, or a combination thereof. After expiration of the time delay, the control system 180 may then open the valve 162 to enable recovery of refrigerant from the condenser 106 via the recovery circuit 166.

In certain embodiments, when switching from the cooling operating mode to the reheat operating mode, the control system 180 may first remove power from the valve 160 to close the valve 160 and substantially block flow of the refrigerant along the recovery circuit 164. Then, the control system 180 may provide a signal to the three-way valve 124 to switch from being fluidly coupled to the cooling circuit 101 to being fluidly coupled to the reheat circuit 144. As mentioned above, actuation of the three-way valve 124 by the control system 180 may trigger execution of the time delay via the time delay relay 186. After execution of the time delay by the control system 180, the control system 180 may provide power to the valve 162 to open the valve 162 and enable recovery of the refrigerant from the condenser 106. In this manner, the control system 180 may execute the time delay to facilitate transition of the HVAC system 100 from the cooling operating mode to the reheat operating mode, and more particularly, to improve positional switching of the three-way valve 124 during the transition from the cooling operating mode to the reheat operating mode.

Additionally or alternatively, to facilitate transition of the HVAC system 100 from the reheat operating mode to the cooling operating mode, the control system 180 may first remove power from the valve 162 to close the valve 162 and substantially block flow of the refrigerant along the recovery circuit 166. Then, the control system 180 may provide a signal to the three-way valve 124 to transition from the reheat operating mode position 170 of FIG. 6 to the cooling operating mode position 126 of FIG. 5. While the three-way valve 124 transitions from a position enabling operation of the reheat circuit 144 to a position enabling operation of the cooling circuit 101, the valve 160 may remain closed. As such, a pressure within the reheat circuit 144 may be greater than or substantially the same as a pressure within the cooling circuit 101. The greater or substantially similar pressure within the cooling circuit 101 may facilitate transition of the three-way valve 124 from a position fluidly coupled to the reheat circuit 144 to a position fluidly coupled to the cooling circuit 101. Upon actuation of the three-way valve 124, the control system 180 may execute the time delay, via the time delay relay 186, prior to opening the valve 160 in order to facilitate or assist actuation of the three-way valve 124 via the pressure of the refrigerant within the reheat heat exchanger 114 and within the reheat circuit 144 generally. After expiration of the time delay, the control system 180 may then open the valve 160 to enable recovery of refrigerant from the reheat heat exchanger 114 via the recovery circuit 164.

In certain embodiments, when switching from the reheat operating mode to the cooling operating mode, the control system 180 may first remove power from the valve 162 to close the valve 162 and substantially block flow of the refrigerant along the recovery circuit 166. Then, the control system 180 may send a control signal to the three-way valve 124 to switch from being fluidly coupled to the reheat circuit 144 to being fluidly coupled to the cooling circuit 101. As mentioned above, actuation of the three-way valve 124 by the control system 180 may trigger execution of the time delay via the time delay relay 186. For example, the time delay may be calculated or determined based on a time associated with a control signal sent to the three-way valve 124. After execution of the time delay by the control system 180, the control system 180 may provide power to the valve 160 to open the valve 160 and enable recovery of the refrigerant from the reheat heat exchanger 114. In this manner, the control system 180 may execute the time delay to facilitate transition of the HVAC system 100 from the reheat operating mode to the cooling operating mode, and more particularly, to improve positional switching of the three-way valve 124 during the transition from the reheat operating mode to the cooling operating mode. It should be noted that, in certain embodiments, the control system 180 may be integrated with the control system 150, such as integral to a main controller or panel of the HVAC system 100, such that the control system 150 may execute the time delay prior to opening the valve 160 or the valve 162.

The control systems described herein, such as the control panel 82 and the control systems 150 and 180 may include processors, such as the processors 86 and 182, and memories, such as the memories 88 and 184. The processors may be used to execute software, such as software stored in the memories for controlling the HVAC system 100. Moreover, the processors may include multiple microprocessors, one or more "general-purpose" microprocessors, one or more special-purpose microprocessors, and/or one or more application specific integrated circuits (ASICS), or some combination thereof. For example, the processors may include one or more reduced instruction set (RISC) or complex instruction set (CISC) processors. Each of the memories may include a volatile memory, such as random access memory (RAM), and/or a nonvolatile memory, such as read-only memory (ROM). The memories may store a variety of information and may be used for various purposes. For example, the memories may store processor-executable instructions, such as firmware or software for controlling the HVAC system 100, for the processors to execute. The storage device(s) may include ROM, flash memory, a hard drive, or any other suitable optical, magnetic, or solid-state storage medium, or a combination thereof. The storage device(s) may store data, instructions, and any other suitable data. The processors and/or the memories may be located in any suitable portion of the system. For example, a memory device for storing instructions, such as software or firmware for controlling portions of the HVAC system 100, may be located in or associated with any of the control systems.

Figure 7:
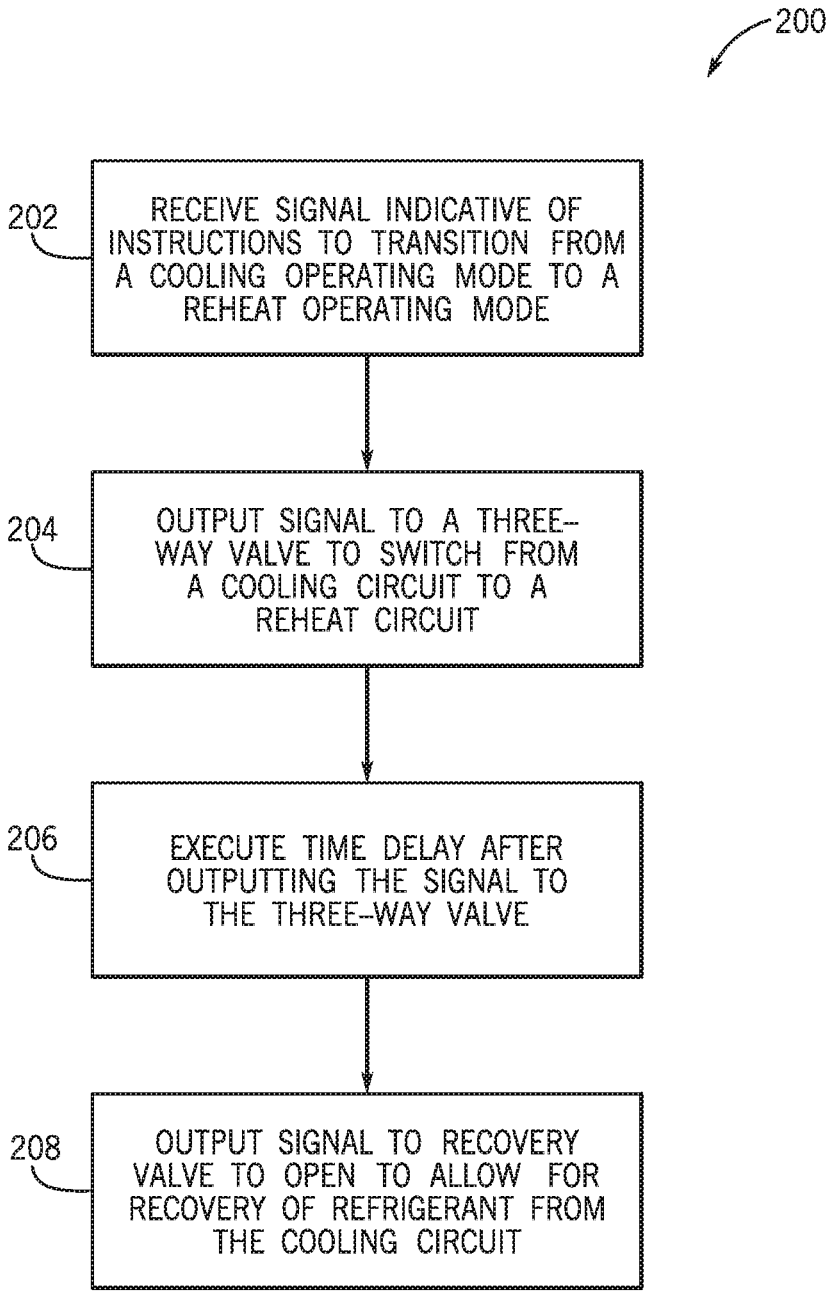
FIG. 7 is a flow diagram of a process for adjusting the position of a three-way valve of the HVAC system of FIG. 5 from a cooling operating mode position to a reheat operating mode position, in accordance with an embodiment of the present disclosure.

FIG. 7 is a flow diagram of a process 200 for switching the three-way valve 124 of the HVAC system 100 of FIG. 5 from the cooling mode operating position 126 to the reheat mode operating position 170. In certain embodiments, the control system 180 of the HVAC system 100 may perform some or all of the steps of the process 200. At block 202, the control system 180 may receive a signal indicative of instructions to transition the HVAC system 100 from the cooling operating mode to the reheat operating mode. The signal may be received from another controller of the HVAC system 100, such as the control system 150. In certain embodiments, block 202 may be omitted. For example, the control system 180 may determine that the HVAC system 100 should transition from the cooling operating mode to the reheat operating mode based on sensed parameters, such as a sensed temperate and/or humidity, operator inputs, and other inputs.

At block 204, the control system 180 may output a signal to the three-way valve 124 indicative of instructions to switch from a position enabling operation of the cooling circuit 101 to a position enabling operation of the reheat circuit 144. In response, the three-way valve 124 may switch from a position fluidly coupled with the cooling circuit 101 to a position fluidly coupled with the reheat circuit 144 in order to transition the HVAC system 100 from the cooling operating mode to the reheat operating mode.

At block 206, the control system 180 may execute the time delay via the time delay relay 186. For example, execution of the time delay may be triggered or initiated upon the output of the signal to the three-way valve 124 to switch positions. As described above, the time delay may be any suitable time period, such as between about one second and about thirty minutes, to enable the three-way valve 124 to switch from the cooling circuit 101 operating position to the reheat circuit 144 operating position before the recovery valve 162 is opened. During the time delay, the pressure of refrigerant within the condenser 106 and the cooling circuit 101 may enable improved positional switching of the three-way valve 124. For example, the pressure of refrigerant within the condenser 106 and the cooling circuit 101 may enable faster switching of the three-way valve 124 and/or may ensure that the position of the three-way valve is switched completely. The time delay may be determined via user input and/or may be calculated by the control system 180 based on user input(s), a type of refrigerant, relative sizes/lengths of the cooling circuit 101 and the reheat circuit 144, a sensed pressure of the cooling circuit 101, a sensed pressure of the reheat circuit 144, or a combination thereof.

After execution of the time delay, the control system 180 may, as indicated by block 208, output a signal to the recovery valve 162 to open and enable recovery of the refrigerant from the cooling circuit 101 and the condenser 106. In response, the recovery valve 162 may open to allow the refrigerant to flow or drain from the cooling circuit 101 and the condenser 106, through the recovery circuit 166, and back to the reheat circuit 144 upstream of the compressor 104. As such, the control system 180, via the process 200, enables improved transition from the cooling operating mode to the reheat operating mode, and particularly improved positional transition of the three-way valve 124, while also enabling recovery of the refrigerant from the cooling circuit 101 and the condenser 106.

Figure 8:
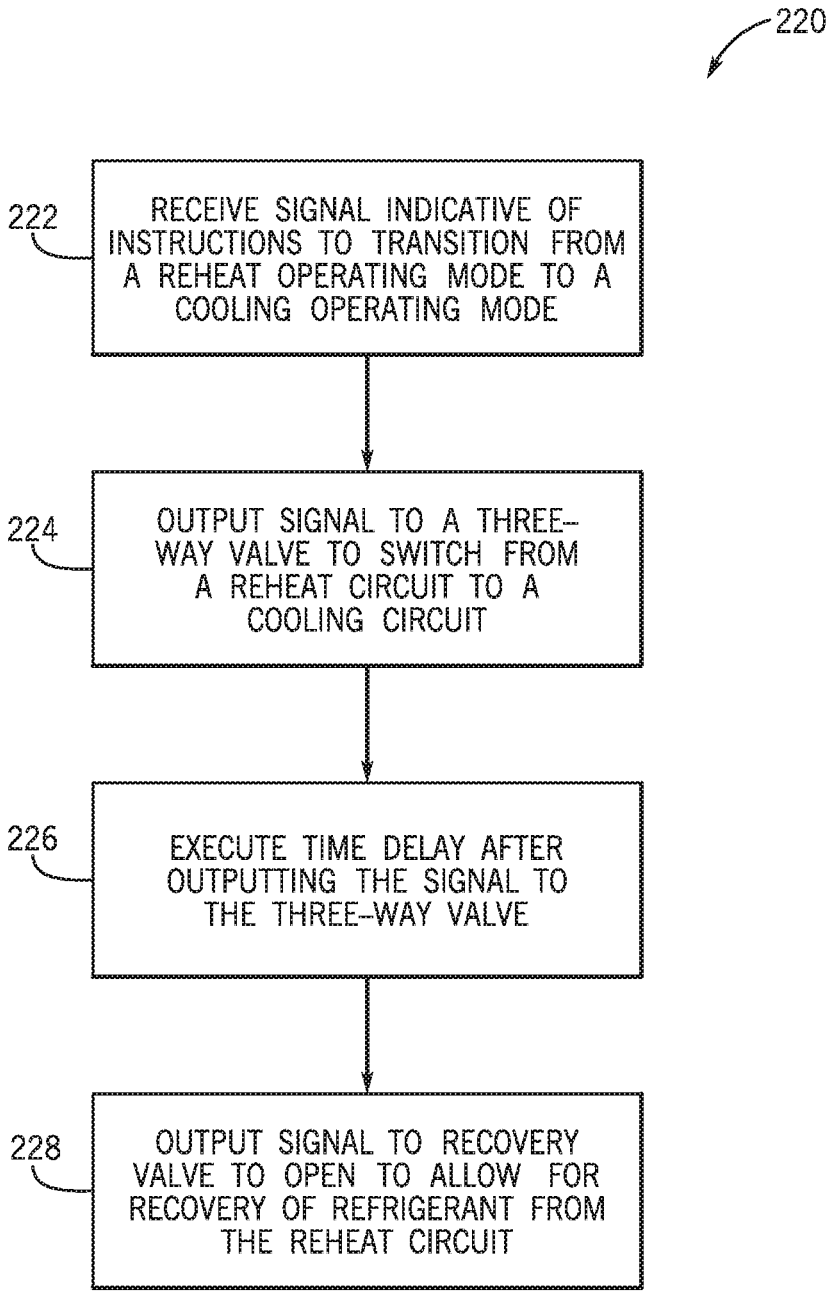
FIG. 8 is a flow diagram of a process for adjusting the position of a three-way valve of the HVAC system of FIG. 6 from a reheat operating mode position to a cooling operating mode position, in accordance with an embodiment of the present disclosure.

FIG. 8 is a flow diagram of a process 220 for switching the three-way valve 124 of the HVAC system 100 of FIG. 6 from the reheat operating mode to the cooling operating mode. In certain embodiments, the control system 180 of the HVAC system 100 may perform some or all of the steps of the process 220. At block 222, the control system 180 may receive a signal indicative of instructions to transition the HVAC system 100 from the reheat operating mode to the cooling operating mode. The signal may be received from another controller of the HVAC system 100, such as the control system 150. In certain embodiments, block 222 may be omitted. For example, the control system 180 may determine that the HVAC system 100 should transition from the reheat operating mode to the cooling operating mode based on sensed parameters, such as a sensed temperate and/or humidity, operator inputs, and other inputs.

At block 224, the control system 180 may output a signal to the three-way valve 124 indicative of instructions to switch from a position enabling operation of the reheat circuit 144 to a position enabling operation of the cooling circuit 101. In response, the three-way valve 124 may switch from the reheat circuit 144 to the cooling circuit 101 in order to transition the HVAC system 100 from the reheat operating mode to the cooling operating mode.

At block 226, the control system 180 may execute the time delay via the time delay relay 186. For example, execution of the time delay may be triggered or initiated upon the output of the signal to the three-way valve 124 to switch positions. As described above, the time delay may be any suitable time period to enable the three-way valve 124 to switch from the reheat mode operating position 170 to the cooling mode operating position 126 before the recovery valve 160 is opened. During the time delay, the pressure of refrigerant within the reheat heat exchanger 114 and the reheat circuit 144 may enable improved positional switching of the three-way valve 124. For example, the pressure of refrigerant within the reheat heat exchanger 114 and the reheat circuit 144 may enable faster switching of the three-way valve 124 and/or may ensure that the position of the three-way valve is switched completely. The time delay may be determined via user input and/or may be calculated by the control system 180 based on user input(s), a type of refrigerant, relative sizes/lengths of the cooling circuit 101 and the reheat circuit 144, a sensed pressure of the cooling circuit 101, a sensed pressure of the reheat circuit 144, or a combination thereof.

After execution of the time delay, the control system 180 may, as indicated by block 228, output a signal to the recovery valve 160 to open and enable recovery of the refrigerant from the reheat circuit 144 and the reheat heat exchanger 114. In response, the recovery valve 160 may open to allow the refrigerant to flow or drain from the reheat circuit 144 and the reheat heat exchanger 114, through the recovery circuit 164, and back to the cooling circuit 101 upstream of the compressor 104. As such, the control system 180, via the process 220, enables improved transition from the reheat operating mode to the cooling operating mode, and particularly improved positional transition of the three-way valve 124, while also enabling recovery of the refrigerant from the reheat circuit 144 and the reheat heat exchanger 114.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A heating, ventilation, and/or air conditioning (HVAC) system, comprising:

a cooling circuit including a condenser, a compressor, an evaporator, and a three-way valve, wherein the HVAC system is configured to circulate refrigerant through the cooling circuit in a cooling operating mode;

a reheat circuit including a reheat heat exchanger, the compressor, the evaporator, and the three-way valve, wherein the HVAC system is configured to circulate refrigerant through the reheat circuit in a reheat operating mode;

a recovery circuit extending between the condenser and the compressor and including a recovery valve; and a control system comprising a time delay relay configured to execute a time delay, wherein the control system is configured to:

send a first signal to the three-way valve to switch the HVAC system from the cooling operating mode to the reheat operating mode;

execute the time delay via the time delay relay after sending the first signal; and send a second signal to the recovery valve of the HVAC system to recover refrigerant from the cooling circuit after executing the time delay in order to maintain pressure in the condenser during the time delay.

2. The HVAC system of claim 1, wherein the time delay relay is external to a main controller of the control system.

3. The HVAC system of claim 1, wherein the time delay relay is integral to a main controller of the control system.

4. The HVAC system of claim 1, wherein the control system is configured to switch the HVAC system from the cooling operating mode to the reheat operating mode prior to sending the second signal.

5. The HVAC system of claim 1, wherein the recovery circuit extends from a first location along the cooling circuit upstream of the condenser and downstream of the three-way valve relative to a refrigerant flow through the cooling circuit and to a second location along the cooling circuit upstream of the compressor relative to the refrigerant flow.

6. The HVAC system of claim 1, comprising an additional recovery circuit extending between the reheat heat exchanger and the compressor and including an additional recovery valve, wherein the control system is configured to:

send a third signal to the three-way valve to switch from the reheat operating mode to the cooling operating mode;

execute an additional time delay via the time delay relay after sending the third signal; and send a fourth signal to the additional recovery valve of the HVAC system to recover refrigerant from the reheat circuit after executing the additional time delay in order to maintain pressure in the reheat heat exchanger during the additional time delay.

7. The HVAC system of claim 6, wherein the additional recovery circuit extends from a first location along the reheat circuit upstream of the reheat heat exchanger and downstream of the three-way valve relative to a refrigerant flow through the reheat circuit and to a second location along the reheat circuit upstream of the compressor relative to the refrigerant flow.

8. The HVAC system of claim 1, wherein the time delay is between one second and thirty seconds.

9. The HVAC system of claim 1, wherein the time delay is between five seconds and sixty seconds.

10. The HVAC system of claim 1, wherein the control system is an external control system, the HVAC system comprises a main control system configured to regulate operation of the compressor, and the external control system is communicatively coupled to the main control system.

11. The HVAC system of claim 1, wherein the control system is configured to determine the time delay based on a pressure of the cooling circuit, a pressure of the reheat circuit, or both.

12. The HVAC system of claim 1, wherein the control system is configured to send the second signal to the recovery valve to transition the recovery valve from a closed position to an open position.

13. A control system for a heating, ventilation, and/or air conditioning (HVAC) system, wherein the control system comprises:

a three-way valve configured to actuate to direct refrigerant through a cooling circuit of the HVAC system in a cooling operating mode and through a reheat circuit of the HVAC system in a reheat operating mode;

a recovery valve configured to actuate to direct refrigerant from the cooling circuit to a recovery circuit of the HVAC system; and a controller configured to be communicatively coupled to a main controller of the HVAC system and configured to receive control signals from the main controller, wherein the controller is further configured to:

execute a time delay after sending a first signal to actuate the three-way valve to switch from the cooling operating mode to the reheat operating mode; and send a second signal to actuate the recovery valve of the HVAC system after execution of the time delay, wherein the controller is external to the main controller.

14. The control system of claim 13, wherein the controller is configured to determine the time delay based on one or more operating conditions of the HVAC system, one or more operator inputs, or both.

15. The control system of claim 13, comprising an additional recovery valve configured to actuate to direct refrigerant from the reheat circuit of the HVAC system to an additional recovery circuit.

16. The control system of claim 15, wherein the controller is configured to send the second signal to actuate the additional recovery valve after execution of the time delay.

17. The control system of claim 15, wherein the controller is configured to maintain the recovery valve, the additional recovery valve, or both, in a closed position during operation of the HVAC system.

18. The control system of claim 13, wherein the recovery circuit extends from a first location along the cooling circuit upstream of a condenser and downstream of the three-way valve relative to a refrigerant flow through the cooling circuit and to a second location along the cooling circuit upstream of a compressor relative to the refrigerant flow.

19. The control system of claim 13, wherein the controller is configured to determine the time delay based on one or more operating conditions of the HVAC system, and wherein the one or more operating conditions comprises a type of refrigerant, relative sizes of the cooling circuit and the reheat circuit, relative lengths of the cooling circuit and the reheat circuit, a pressure of the cooling circuit, a pressure of the reheat circuit, or a combination thereof.

20. A heating, ventilation, and/or air conditioning (HVAC) system, comprising:

a cooling circuit including a condenser, a compressor, an evaporator, and a three-way valve, wherein the HVAC system is configured to circulate refrigerant through the cooling circuit in a cooling operating mode;

a reheat circuit including a reheat heat exchanger, the compressor, the evaporator, and the three-way valve, wherein the HVAC system is configured to circulate refrigerant through the reheat circuit in a reheat operating mode;

a first recovery circuit extending between the condenser and the compressor and including a first recovery valve;

a second recovery circuit extending between the reheat heat exchanger and the compressor and including a second recovery valve;

a main control system configured to regulate operation of the compressor; and an external control system communicatively coupled to the main control system, wherein the external control system is configured to send a first signal to the three-way valve to switch the HVAC system from the cooling operating mode to the reheat operating mode and configured to subsequently send a second signal to the first recovery valve to recover refrigerant from the cooling circuit after a time delay calculated based on the first signal to maintain pressure in the condenser during the time delay.

21. The HVAC system of claim 20, wherein the HVAC system is configured to operate such that a first pressure within the cooling circuit is equal to or greater than a second pressure within the reheat circuit prior to the three-way valve switching from the cooling operating mode to the reheat operating mode.

22. The HVAC system of claim 20, wherein the three-way valve is configured to switch the HVAC system from the cooling operating mode to the reheat operating mode in less than two seconds based on receiving the first signal.

23. The HVAC system of claim 20, wherein the time delay is greater than or equal to two seconds.

* * * * *